United States Patent [19]

Ševčík

[11] 4,385,649

[45] May 31, 1983

[54] DEVICE FOR PROGRAMMED CHANGE OF POSITION OF NOZZLES IN JET LOOMS

[75] Inventor: Ladislav Ševčík, Chrastava, Czechoslovakia

[73] Assignee: ELITEX, koncern textilniho strojirenstvi, Liberec, Czechoslovakia

[21] Appl. No.: 218,761

[22] Filed: Dec. 22, 1980

[30] Foreign Application Priority Data

Dec. 22, 1979 [CS] Czechoslovakia ..... 9242-79

[51] Int. Cl.[3] ..... D03D 47/30

[52] U.S. Cl. ..... 139/435; 74/55; 74/56

[58] Field of Search ..... 139/66 R, 76, 80, 171, 139/429, 435, 439, 453; 74/55, 56, 567, 569

[56] References Cited

U.S. PATENT DOCUMENTS

| | | | |
|---|---|---|---|
| 3,403,707 | 10/1968 | Schedin | 139/171 |
| 3,482,606 | 12/1969 | Mizuno et al. | 139/435 |
| 3,664,203 | 5/1972 | Pataki | 74/55 |
| 3,804,128 | 4/1974 | Amiques | 139/66 R |
| 4,178,971 | 12/1979 | Malasek et al. | 139/435 |

*Primary Examiner*—Henry Jaudon

[57] ABSTRACT

Apparatus for the programmed change of position of one or more members, particularly of the nozzles of jet looms. The disadvantages of similar prior devices are mitigated by the arrangement of the device according to the invention in which a driving cam is provided with an auxiliary cam path for the cam following pin of a combined cam follower element, said pin being mounted axially displaceably on the carrier of the combined cam follower element and being urged toward the cam by a spring. One of the ends of said pin is controlled by the auxiliary cam path, while in the vicinity of the other end there is mounted a controlled arresting mechanism. The driving cam can be made in the form of a box or a globoidal cam. In the embodiment employing a globoidal cam, the pin of the combined cam follower element has its opposite ends of similar construction, while the combined cam follower element includes further auxiliary guiding pins which are arranged crosswise with respect to the pin of the cam follower.

9 Claims, 9 Drawing Figures

DEVICE FOR PROGRAMMED CHANGE OF POSITION OF NOZZLES IN JET LOOMS

The present invention relates to a device for programmed change of position, particularly for nozzles of jet looms, by means of a carrier controlled by a driving cam by an intermediary of a combined cam element and a controlled arresting element.

The hitherto known devices for a programmed change of nozzles are based on driving members, e.g. eccentrics which, by mutual combination of their position of eccentricity, adjust the cam into the programmed position. The disadvantage of such device is an intermittent operation of the eccentric and its exact stoppage in the selected position. With high operating speeds of jet looms, this operation is unreliable, and the device reduces the operating speed of the loom.

The above mentioned disadvantages are mitigated by the device of the present invention for programmed change of position, particularly for nozzles in jet looms, by the intermediary of a driving cam, and a carrier of a combined cam element connected with the nozzles. The driving cam is provided with an auxiliary cam path for the pin of the combined cam element, said pin being mounted axially displaceably on the carrier and resiliently loaded by means of a spring, and while one of its ends is controlled by the auxiliary cam path, the arresting element, which is controlled, is attached to its other end.

By providing the driving cam with an auxiliary cam path, it is made possible to shift the pin of the combined cam element out of engagement with the sides of the driving cam, and to perform by the intermediary of the controlled arresting element the selection of the position change by re-engaging the pin with the sides of the driving cam without the necessity of stopping the cam. A considerable simplification of the design is obtained by the device according to the present invention in comparison with the devices hitherto known, together with a great power effect by the sides of the driving cam, this being advantageous in its application to jet looms. It is also advantageous that the device for changing position of the nozzles can be readjusted within short time intervals, this being an indispensable condition for change motions in high speed jet looms.

Further advantages and features of the present invention are specified in the following specification and represented in form of example in diagrammatic form in the accompanying drawings, in which:

Figure 2:
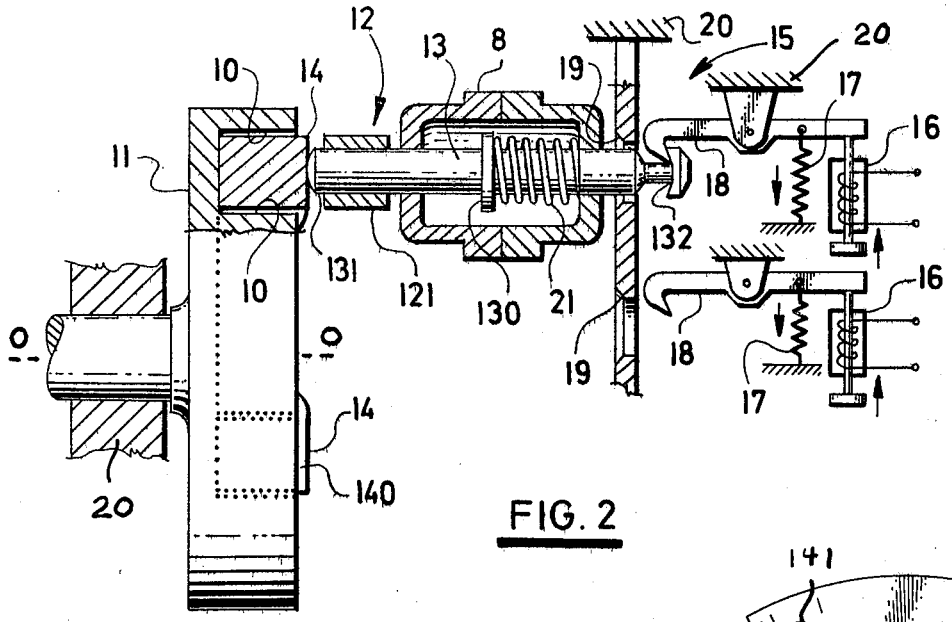
FIG. 2 is a fragmentary view in section of the device of FIG. 1, the section being taken along the line 2—2 in FIG. 1.

Turning first to the embodiment of FIGS. 1–5, incl., the shed S of the loom is formed by warp threads 1 and 2, which are controlled by healds 3 and 4, mounted on heald shafts (not shown). The weft, which is inserted into the shed by means of a selected one of the two nozzles 6 and 7, is beaten up by reed 5 which is mounted, upon a slay 150. The said nozzles 6 and 7 are mounted when the arrangement of the weft inserting mechanism of the loom is arranged laterally, on a carrier 8 for a combined cam follower element 12, the carrier being mounted pivotally on a pin 9 which is inserted into frame 20 of the loom. The control of carrier 8 and thus also the directing of the inserting fluid from the selected one of nozzles 6 and 7 into the shed according to a selected program is performed by a device including a drive box cam 11 and a combined cam follower element 12 mounted on carrier 8, as well as a controlled arresting mechanism 15 (FIG. 2).

Figure 4:
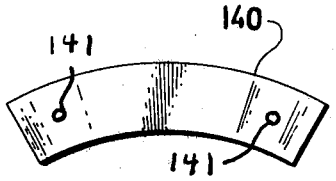
FIG. 4 is a view in front elevation of an auxiliary cam part of the driving cam shown in FIGS. 1, 2, and 3.
Figure 5:
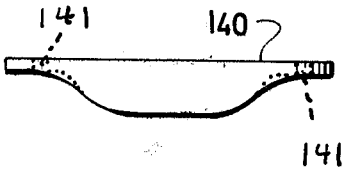
FIG. 5 is a view in plan of the auxiliary cam part shown in FIG. 4.

The driving cam 11, which rotates about axis O, is provided with a basic cam path 10 in the form of e.g. a groove, and auxiliary cam path portions 14 (FIG. 2) formed either directly on the driving cam 11 or, as shown in the examplary embodiment, by auxiliary cams 140, 140', the shape of cam 140 being shown in FIGS. 4 and 5. The said auxiliary cams 140, 140', which differ only as to circumferential length, are fixed e.g., by means of screws 142 passing through holes 141 therein, in the basic cam path 10 in the dwell points of such basic cam path.

The combined cam follower element 12 (FIGS. 2 and 3) is formed by a pin 13 mounted axially displaceably on carrier 8 and constantly thrust toward cam 11 by a coil compression spring 21, one end of which bears against a flange 130 on pin 13, and the other end of which bears against member 8. The end 131 of pin 13 which confronts the cam groove 10 is advantageously provided with a roller 121, as shown, and cooperates with the basic cam path 10 and the raised parts 140 and 140' thereof. The other end 132 of pin 13, which projects from the other side of carrier 8, cooperates with the controlled arresting mechanism 15.

In the embodiment shown, to position nozzles 6, 7 in each of their possible extreme positions, the controlled arresting mechanism 15 includes a centering body 19 mounted on the machine frame 20, and two pivotally mounted pawls 18 each of which is constantly urged in a clockwise direction (FIG. 2) by a coil tension spring 17. The pawls are controlled either mechanically or, as shown in FIG. 2, by means of solenoids 16 connected to a suitable source of electrical pulses (not shown). The controlled arresting mechanism 15 can be made in other forms; thus instead of pawls 18, it is possible to use collets or only electromagnets acting directly upon the end of pin 13, or the like.

The apparatus of FIGS. 1–5, incl., is operated in such manner that the driving cam 11 constantly rotates synchronously with the loom. The combined cam follower element 12, which cooperates with the basic cam path 10 and the auxiliary cam path 14 (that is, the auxiliary cam parts 140, 140'), swings the carrier 8 from one extreme position thereof into the other and vice versa, upon each revolution of cam 11. With the oscillation of carrier 8, nozzles 6, 7 mounted thereon are displaced, one of the nozzles in one extreme position thereof and the other nozzle in the other extreme position being directed into the open shed formed by warp threads 1, 2. In each of such extreme positions, the position of the nozzles is stabilized by engagement with the combined cam element 12 with the cam parts 140, 140' constituting the auxiliary cam path 14. By the action of the auxiliary cam path 14, pin 13 of the combined cam follower element 12 is displaced to the right with respect to the centering body 19, and carrier 8 with nozzles 6, 7 remains in its then extreme position until, upon the advancing rotation of the cam 11, pin 13 of the combined cam follower element 12 comes down from the peak of the part of the auxiliary cam path 14 which it has previously engaged and is then thrust to the left by the action of spring 21, from its right hand, disengaged position back into engagement with the basic cam path 10.

Figure 3:
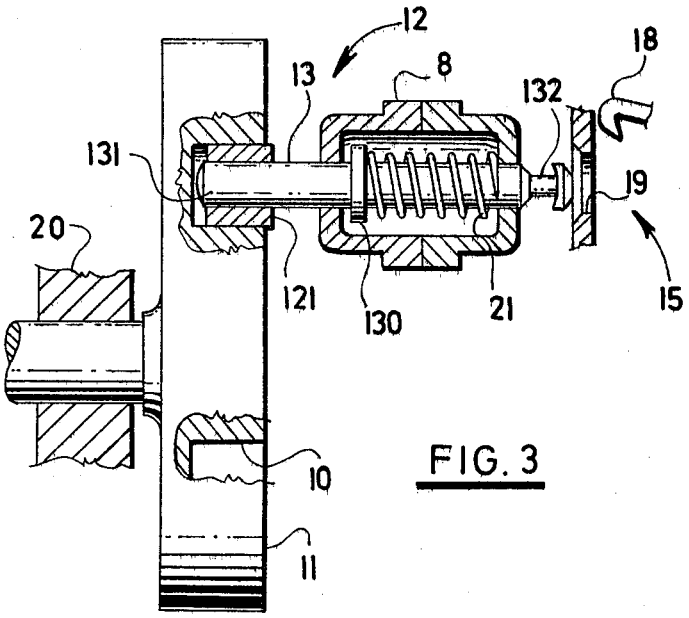
FIG. 3 is a view in section similar to FIG. 2 but with the driving cam having been displaced angularly from the position thereof shown in FIG. 2.

Assuming that solenoids 16 are not energized, the rearrangement of nozzles 6, 7 as described above, is constantly repeated. The springs 17 then hold the pawls 18 of the controlled arresting mechanism 15 in their rest position out of contact with the end 132 of pin 13 of the combined cam follower element 12, as shown in FIG. 3. However, when the nozzles 6, 7 are in their upper position and the upper pawl 18 engages and locks with the latch on the right hand end 132 of pin 13, the upper solenoid 16 is energized. The upper pawl 18 thus holds the carrier 8 with nozzles 6, 7 in the position shown in FIG. 2 until the upper solenoid 16 is deenergized so that the upper spring 17 then releases pin 13 by disengagement of the upper pawl 18 from latch 132. The pin 13 is then thrust to the left by spring 21 from its disengaged, right hand, position back into engagement with the basic cam path 10. It is to be understood that the lower parts of the arresting mechanism 15 act in the same manner when the cam follower 12 positions the nozzles 6, 7 in their lower position.

The embodiment of FIGS. 1–5, incl., is suitable for looms of conventional design. For looms with central weft insertion, it is advantageous to employ the embodiment of FIG. 6. In such embodiment, with the simultaneous weaving of two parallel fabrics, the nozzles 6, 7 are arranged on a carrier 8 in such manner that the direction of the fluid flowing from nozzles 6, 7 is normal to the axis 900 of rotation of carrier 8, which is similar to carrier 8 of the first described embodiment. A globoidal cam 110 is used as the driving cam. In a manner similar to that of the driving cam in the preceding embodiment, globoidal cam 110 is provided with an appurtenantly shaped basic cam path 10 and an auxiliary cam path 14, made in a manner similar to that in the preceding embodiment, either directly upon the globoidal cam 110, or as shown in FIG. 6 by using an auxiliary cam 140 fastened to globoidal cam 110 in each of the dwell zones of the basic cam path 10.

The combined cam follower element 12 again includes a pin 13, which is of tubular form, and is mounted displaceably in an axial direction on carrier 8. Pin 13 is provided with a spring 21, or with springs 21, 210 as shown, both ends 131, 132 of pin 13 having the same shape for cooperation both with the basic cam path 10 and the auxiliary cam path 14, as well as for cooperation with the controlled arresting mechanism 15. In view of the fact that a globoidal cam 110 affixed to a shaft 200 rotatable about an axis 200 is used for rotating carrier 8 in the direction of the arrow through successive steps of an angle of 180°, the combined cam follower element 12 includes two auxiliary cam follower pins 122, 123, which are disposed on carrier 8 in crossing arrangement with pin 13. Said pins 122, 123 engage cam tracks 124 and 125 on globoidal cam 110, as shown, and may be, for better contact therewith, provided with rollers (not shown). Even both ends 131 and 132 of pin 13 can be advantageously provided with rollers (not shown) for the same reason.

Figure 6:
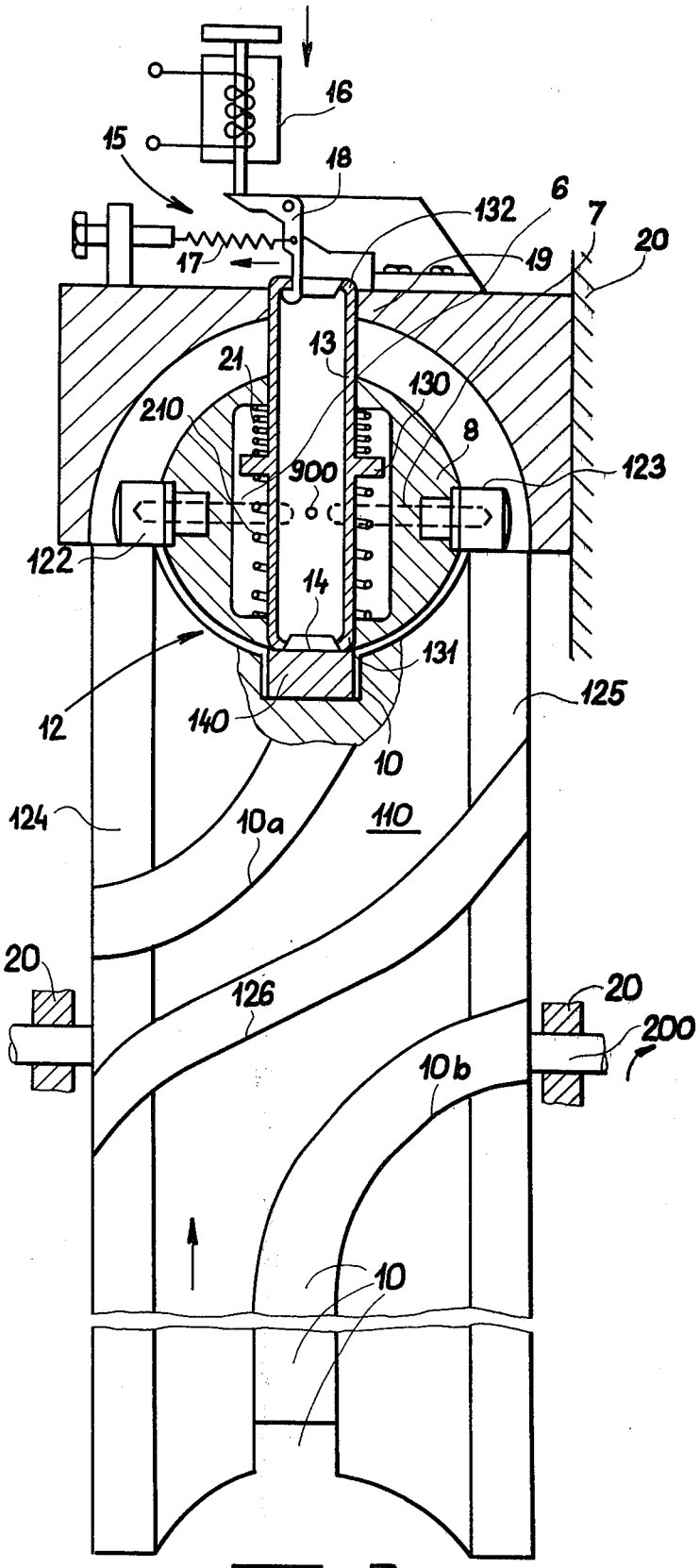
FIG. 6 is a view partially in elevation and partially in section of a second embodiment of the device for programmed change of position of nozzles in accordance with the invention.
Figure 8:
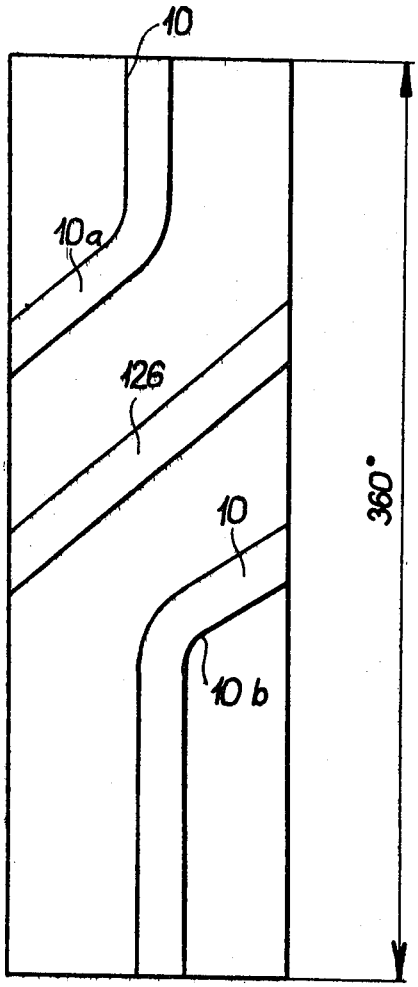
FIG. 8 is a development of a globoidal cam shown in FIG. 6.

Cam 110 is provided with a central cam track 10 which is continuous thereabout except at the portion thereof shown in FIG. 6; thus the central cam track portion 10 at the top of the figure extends to the portion of the cam track 10 shown at the bottom of FIG. 6. Cam track 10 is discontinuous in the part shown, the upper part **10*a* deviating from the center of the cam to the left, and the lower part 10*b* leading in from the right. The cam tracks 124 and 125 are also continuous about cam 110 except in the portion shown, where they are connected by a curved cam track 126**.

The controlled arresting mechanism 15 includes, as in the preceding embodiment, a centering body 19 fastened on the machine frame 20, into which there is engaged, according to the angular displacement of carrier 8, one of the ends 131, 132 of pin 13, a solenoid 16, and a pawl 18 urged clockwise by a coil tension spring 17, said pawl engaging the radially inwardly projecting edges of the ends 131, 132 of pin 13. When said ends 131 and 132 are provided with rollers, which are not shown here, the pawl 18 can engage projections on the rollers.

The embodiment of FIG. 6 operates as follows:

The globoidal cam 110 rotates at constant speed in one direction, the lower end 131 of pin 13 of the combined cam follower element 12, together with the auxiliary cam follower pins 122, 123 being in engagement with the cam, while the other end 132 of pin 13 is directed, as shown in FIG. 6, upwardly towards the controlled arresting mechanism 15. When, in the rotation of the globoidal cam 110, the pin 13 engages the part of the basic cam path 10 which is central of the cam and which is of uniform depth, carrier 8 is at rest and each one of nozzles 6, 7 is directed into one shed. Before the basic cam path 10 begins to deviate to the left, pin 13 is transferred to the auxiliary cam path 14, and is displaced by means thereof upwardly in the axial direction against the action of spring 21 into the centering body 19. This secures, on the one hand, the position of the carrier 8 of the nozzles 6, 7, and, on the other hand, brings pin 13 into a disengaged position with respect to the basic cam path 10.

If at that moment, solenoid 16 is energized, pawl 18 is swung out counterclockwise to free it from engagement with the upper end 132 of pin 13. Thus, as soon as pin 13 is pressed downwardly by spring 21, upon advancing rotation of globoidal cam 110, along the descending part of the auxiliary cam path 14, from its disengaged position shown in FIG. 6, back into engagement with the basic cam path 10, the carrier 8 starts to turn clockwise due to the curvature of the portion **10*a* of the basic cam path 10. Due to the turning movement the follower pin 122 starts to move away from the circumference 124** of the cam 110, whereas the follower pin 123 penetrates into the cam track 126. When the carrier 8 has been turned through 90° a situation is created in which the pin 13, having left its initial vertical position shown in FIG. 6, reaches a horizontal position, whereas the follower pins 122 and 123 assume a vertical position, the follower pin 123 being engaged in the cam track 126. Due to the continuing turning movement of the globoidal cam 110 and under the effect of the curvature of the cam track 126, the end 132 of pin 13 penetrates into the portion 10*b* of the cam path 10. The turning movement of the carrier 8 through 180° is completed at the moment when the end 132 is brought by the cam track 106 into its vertical position and the follower pins 122 and 123 abut against circumferences 124 and 125 of the globoidal cam 110 respectively.

However, if at the moment at which end 131 of pin 13 follows the auxiliary cam path 14, solenoid 16 is de-energized, pawl 18 catches, by the action of spring 17, the upper end 132 of pin 13 and holds it against the action of spring 21, upon the advancing rotation of globoidal cam 110, disengaged from the basic cam path 10, and the position of the carrier 8 of nozzles 6, 7 remains unchanged.

Only by energizing the solenoid 16 at the moment at which pin 13 is in disengaged position with respect to the basic cam path 10 is the pawl 18 disengaged from pin 13 and the pin 13 released and is then further along the auxiliary cam path 14 inserted by means of spring 21 into the basic cam path 10. A further angular displacement of the carrier 8 with nozzles 6, 7 through 180° is brought about by the curvature of the basic path 10 as the cam 110 continues to rotate.

Figure 9:
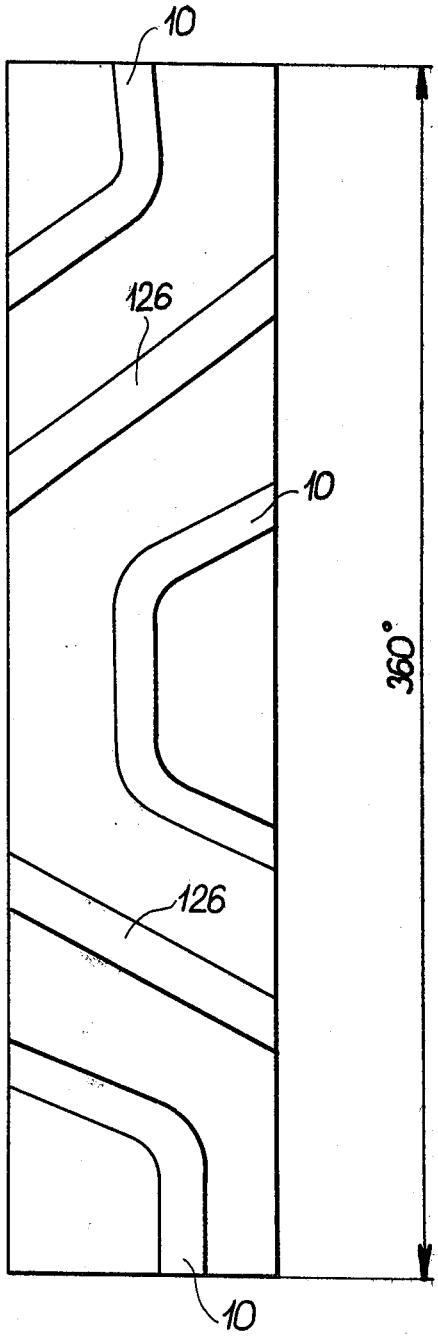
FIG. 9 is a development of a modified globoidal cam employed in an embodiment of the invention which is a modification of FIG. 6; in such modification the nozzle carrier is displaced in opposite directions upon each revolution of the globoidal cam.

In the described device with the cam tracks shown the globoidal cam 110 rotates the carrier 8 through 180° in one direction for each revolution of the globoidal cam 110 (FIG. 6). By a mere modification of the basic cam path 10 and of the auxiliary cam path 14 shown, it is possible for the carrier 8 to be displaced, twice in opposite directions upon each revolution of the globoidal cam, through twice 180° in opposite directions; this is advantageous for a simpler feeding of weft yarns to nozzles 6, 7. Such modification of the basic cam path 10 is illustrated in FIG. 9.

Figure 1:
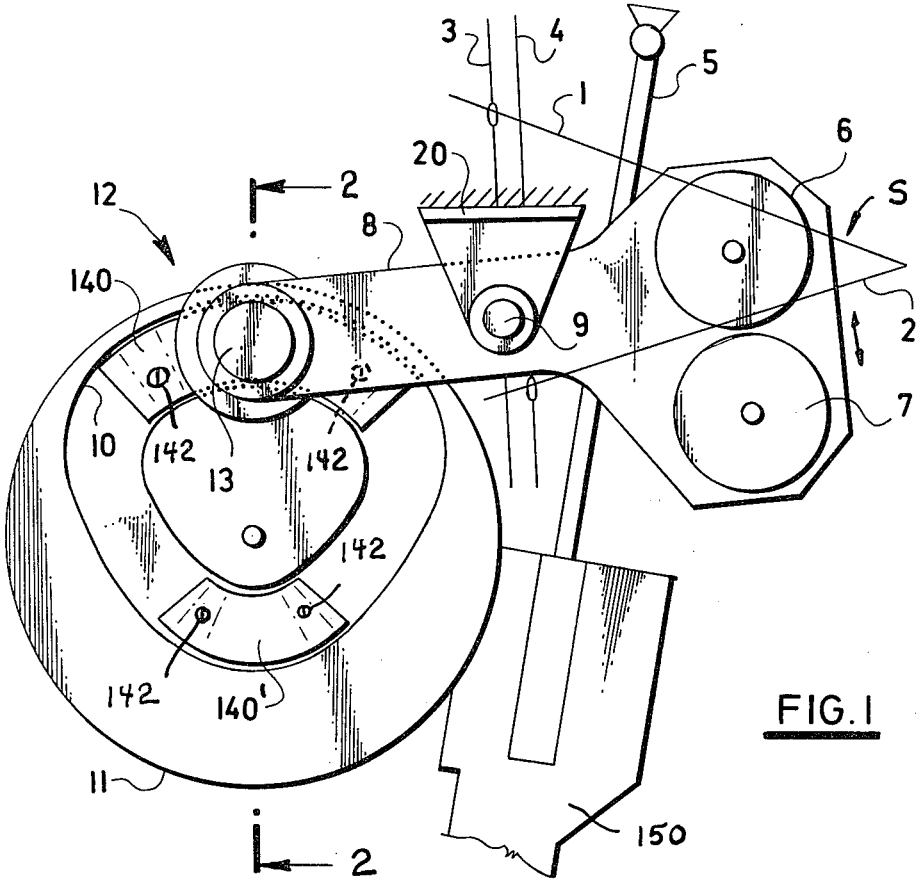
FIG. 1 is a view in side elevation of a first embodiment of the device for programmed change of position of nozzles when mounted on a swingable carrier of a combined cam element.
Figure 7:
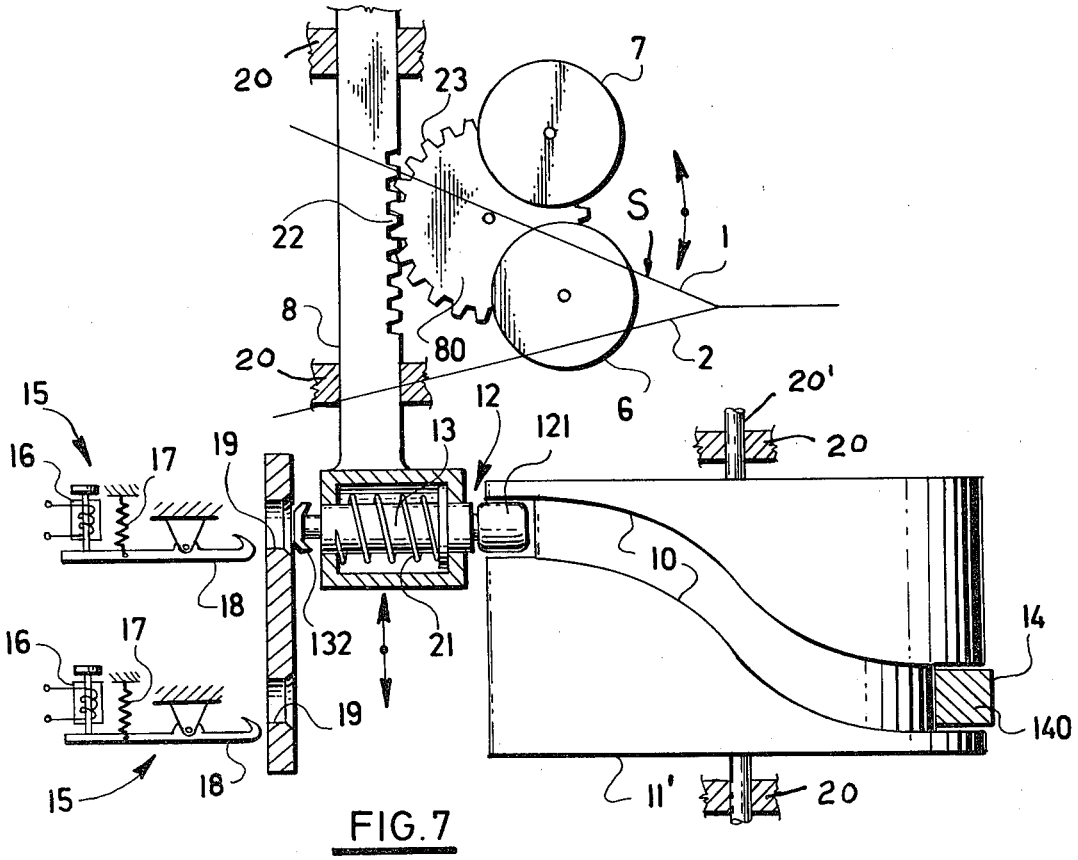
FIG. 7 is a fragmentary view partially in elevation and partially in section of a third embodiment for programmed change of position of nozzles in accordance with the invention.

In the two embodiments of the apparatus hitherto described, the carrier 8 of the combined cam follower element 12 is simultaneously the carrier of nozzles 6, 7 and is mounted rotatably on pin 9. In the embodiment of FIG. 7, the carrier 8 of the combined cam follower element 12 is mounted displaceably, and the connection with nozzles 6, 7 is accomplished, e.g. by means of a transmission including a cam 11', a rack 22, a cam follower 21 on the rack, and a gear 23 meshing with the rack, nozzles 6 and 7 being mounted on an auxiliary carrier 80. Instead of a gear drive 22, 23, e.g. a lever transmission or the like may be used. The arresting device 15' of FIG. 7 is the same as that of mechanism 15 of FIGS. 1–5, incl., except that its parts are inverted.

The apparatus as described can also be used for other purposes than the programmed displacement of jet loom nozzles, e.g. for the programmed displacement of heald shafts of looms, or other similar applications in machines and devices with a programmed selection of position.

Although the invention is illustrated and described with reference to a plurality of embodiments thereof, it is to be expressly understood that it is in no way limited to the disclosure of such preferred embodiments but is capable of numerous modifications within the scope of the appended claims.

I claim:

1. A device for the programmed change of position of at least one member of an apparatus, comprising a cam driven in synchronism with the apparatus, a cam follower, the cam having a cam path composed of a main cam path and an auxiliary cam path disposed in series with the main cam path, the cam follower including an axially movable pin, resilient means constantly urging one end of the pin toward the cam path of the cam so as to be controlled thereby, and a controlled selectively operated arresting mechanism coacting with the other end of the pin to retain the pin in the position into which it has been thrust by the auxiliary cam path of the cam.

2. A device according to claim 1, wherein the apparatus is a jet loom, and the member is a weft inserting nozzle of said loom.

3. A device according to claim 2, wherein the cam path has a first zone of maximum eccentricity and a second zone of minimum eccentricity, the auxiliary cam path includes auxiliary cam parts disposed at said first and second zones of the cam path, the auxiliary cam parts thrust the pin from the retracted position which it occupies when the first end of the pin cooperates with the main cam path into an outer terminal position, and the arresting mechanism holds the pin in its outer terminal position.

4. A device as claimed in claim 1, wherein the driving cam is a globoidal cam, comprising a rotatable support in the form of a body of revolution interfitting with the periphery of the globoidal cam, the cam track being disposed in the periphery of the globoidal cam, the pin of the cam follower having two similar ends which alternately engage the cam path of the cam.

5. A device as claimed in claim 4, comprising auxiliary cams attached to and protruding in opposite directions from said support, the auxiliary pins being disposed crosswise to the cam follower pin and the axes of the respective pins intersecting the auxiliary pins cooperating with further surfaces of the globoidal cam in order to guide the support of the cam follower.

6. A device as claimed in claim 1, wherein the controlled arresting mechanism includes the centering body for the cam follower pin and a pawl arranged in the vicinity of the centering body for selectively engaging and holding a latch on the outer end of the cam follower pin, and a solenoid connected to the pawl so that when the solenoid is energized the pawl is moved into its engagement with the latch.

7. A device as claimed in claim 1, wherein at least one end of the cam follower pin is provided with a roller which cooperates with the cam path of the cam.

8. The device as claimed in claim 4, wherein both ends of the cam follower pin are provided with rollers cooperating with such cam path.

9. A device as claimed in claim 4, wherein the auxiliary pins are provided with rollers which cooperate with said further surfaces of the globoidal cam.

* * * * *